United States Patent [19]

DeMoore

[11] 4,402,267

[45] Sep. 6, 1983

[54] METHOD AND APPARATUS FOR HANDLING PRINTED SHEET MATERIAL

[75] Inventor: Howard W. DeMoore, Dallas, Tex.

[73] Assignee: Printing Research Corporation, Dallas, Tex.

[21] Appl. No.: 242,715

[22] Filed: Mar. 11, 1981

[51] Int. Cl.[3] ..... B41F 21/00

[52] U.S. Cl. ..... 101/419; 101/422; 101/426; 118/DIG. 15

[58] Field of Search ..... 101/42.2, 416 R, 417, 101/418, 419, 426; 29/120, 130, 131, 121.3; 118/DIG. 15

[56] References Cited

U.S. PATENT DOCUMENTS

| | | | |
|---|---|---|---|
| 1,231,141 | 6/1917 | Ellis | 101/422 X |
| 1,231,142 | 6/1917 | Ellis | 101/422 X |
| 1,933,161 | 10/1933 | Claybourn et al. | 101/422 |
| 2,878,742 | 3/1959 | Trump | 101/422 UX |
| 3,750,571 | 8/1973 | Germann | 101/415.1 |
| 3,791,644 | 2/1974 | DeMoore . | |
| 3,892,179 | 7/1975 | Jahn | 101/415.1 |
| 3,910,186 | 10/1975 | D'Amato et al. | 29/131 |

OTHER PUBLICATIONS

Seitzinger, R. C., "Coatings That Cut Friction", *Machine Design,* Oct. 21, 1976.

*Primary Examiner*—Edgar S. Burr
*Assistant Examiner*—Moshe I. Cohen
*Attorney, Agent, or Firm*—Fulwider, Patton, Rieber, Lee & Utecht

[57] ABSTRACT

A skeleton wheel or cylinder for supporting freshly printed sheet material between printing stations or at the delivery station of a printing press is provided with a loosely retained ink repellent fabric covering for supporting and conveying the sheet material without transfer of wet ink from one sheet to a successive sheet and without smearing the ink or indenting the surface of the sheet material. The circumferential surface of the skeleton cylinder is provided with a coating of a fluorocarbon plastic having a fabric base portion bonded to the surface of the cylinder structure. The low friction properties of the coating permit ease of shuffling movement of the fabric covering and the coating structure provides a cushioning effect to prevent smearing or indenting the sheet material by the fabric cover. The improved cylinder is provided with a plurality of retaining plates slidably fitted in axially spaced hub portions of the cylinder which plates are each locked in place by a set screw. The rim portion of the cylinder includes opposed parallel flanges on which the opposite ends of the fabric covering may be removably retained.

25 Claims, 4 Drawing Figures

METHOD AND APPARATUS FOR HANDLING PRINTED SHEET MATERIAL

BACKGROUND OF THE INVENTION

1. Field of the Invention

The present invention pertains to a method and apparatus for providing improved support for freshly inked sheet material in a printing press or the like.

2. Background Art

It has been traditional in the art of printing press apparatus and the like to provide devices for supporting freshly inked sheet material when transferring the material from one printing station to another or when handling the sheets as they are delivered from the press wherein said devices comprise wheels of relatively narrow width and characterized by having circumferentially spaced teeth. Such devices are known by the term skeleton wheels in the printing press art. The problems inherent in handling freshly inked printed sheets and the like by skeleton wheels have been longstanding. In order to minimize the contact area between the skeleton wheels and the printed sheet traditional thinking led to the provision of wheels in the form of relatively thin disks having a toothed or serrated circumference. However, these types of wheels have not overcome the problems of smearing and marring the inked surface of the sheet material due to sliding action between the material and the projections or serrations. Moreover, the attempts to minimize the surface area in contact with the sheet material has also resulted in actual indenting or dimpling of the material itself.

Various efforts have been made to overcome the disadvantages of thin disk skeleton wheels. One of the more successful approaches has been completely contrary to the concept of minimizing the surface area. This more recent development is disclosed and claimed in my U.S. Pat. No. 3,791,644 wherein I provide for a substantially cylindrical drum or roller coated with an improved ink repellent surface comprising a layer of polytetrafluoroethylene. Although this improved skeleton wheel has been commercially successful, with continuous use such as is common in many commercial printing operations, there is over a period of time a slight accumulation of ink on the surface of the wheel.

In high speed commercial printing equipment, for example, it has been determined that in order to provide satisfactory printing quality the surface of the coated wheel must be washed relatively frequently with a solvent to remove any ink accumulation. Moreover, it has also been determined that the TFE coated wheels do not provide a cushioning effect which is important for the tightly stretched sheet material as it engages and is supported by the skeleton wheel.

In accordance with the present invention the problems with the prior art thin disk and other type skeleton wheel concepts have been overcome with a skeleton wheel of relatively great width and with an improved ink repellent and supportive structure which may be used in conjunction with the teaching of U.S. Pat. No. 3,791,644 as well as further improvements which I have made in support and handling apparatus for handling freshly inked sheet material.

SUMMARY OF THE INVENTION

The present invention provides an improved method for handling sheet material which has been freshly inked or printed on at least one side wherein the sheet material is supported by a cylindrical roller or skeleton wheel which has mounted on a cylindrical surface thereof a relatively loose woven fabric or the like. In accordance with one aspect of the present invention there is provided a method for handling freshly printed sheet material in a printing press delivery apparatus or the like wherein a cylindrical roller or skeleton wheel has mounted on the support surface of the wheel a woven fabric of cotton or the like and which is relatively loosely supported on the support surface of the wheel. In accordance with another aspect of the present invention there is provided a method of supporting freshly printed sheet material or the like by means of a cylindrical skeleton wheel or roller having a support surface for a relatively lightweight fabric which is provided by a liquid repellent material of low friction characteristics such as one of the fluoroplastics or the like.

In accordance with another aspect of the present invention there is provided an improved skeleton wheel or roller for a printing press which includes a fabric covered supporting surface for engaging freshly printed sheet material or the like. In a preferred embodiment of the present invention the fabric covering for the skeleton wheel or roller comprises a lightweight cotton fabric or the like treated with a suitable liquid repellant. The fabric is relatively loosely supported on the surface of the cylinder or wheel to accommodate any slight relative movement between the sheet material and the skeleton wheel without marring the freshly inked surface or damaging the sheet material itself. The improved support roller or skeleton wheel of the present invention also contemplates a supporting surface for the fabric covering which may include a low friction fluoropolymer layer.

In accordance with another aspect of the improved skeleton wheel of the present invention the cylindrical support surface for the fabric covering may comprise a coated or impregnated fabric bonded to the cylindrical wheel surface and forming a supporting surface for the loosely secured fabric covering which is directly engageable with the sheet material.

The present invention provides a substantially improved yet simple and reliable handling apparatus and method in the form of a skeleton wheel for printing equipment and the like which is adapted to support sheet material including freshly inked surfaces thereof, without smearing or marking the printed surface and without damaging the sheet material itself. The improved fabric covered skeleton wheel of the present invention is easily installed on a printing press and the fabric covering is easily removed for cleaning or replacement as needed. Those skilled in the art will recognize these advantages as well as other superior features of the present invention upon reading the detailed description which follows in conjunction with the drawings.

DESCRIPTION OF THE PREFERRED EMBODIMENTS

The improved method and apparatus for handling sheet material in accordance with the present invention is used in a preferred form on high speed printing equipment of the type used, for example, in off-set printing. Such equipment may include one or more support rollers or wheels for handling the sheet material between printing stages and upon delivery of the printed material to a discharge magazine or stack. The particular location of the improved skeleton wheel or roller of the present invention in a typical printing press is believed to be readily understandable to those skilled in the art. Accordingly, a detailed description of the printing press is not believed to be necessary to a complete understanding of the present invention. In any case, reference may be made to my earlier U.S. Pat. No. 3,791,644 which discloses details regarding the location and function of a skeleton wheel for a typical multistation printing press. The present invention may, of course, be utilized with printing presses having any number of printing and delivery stations.

Figure 1:
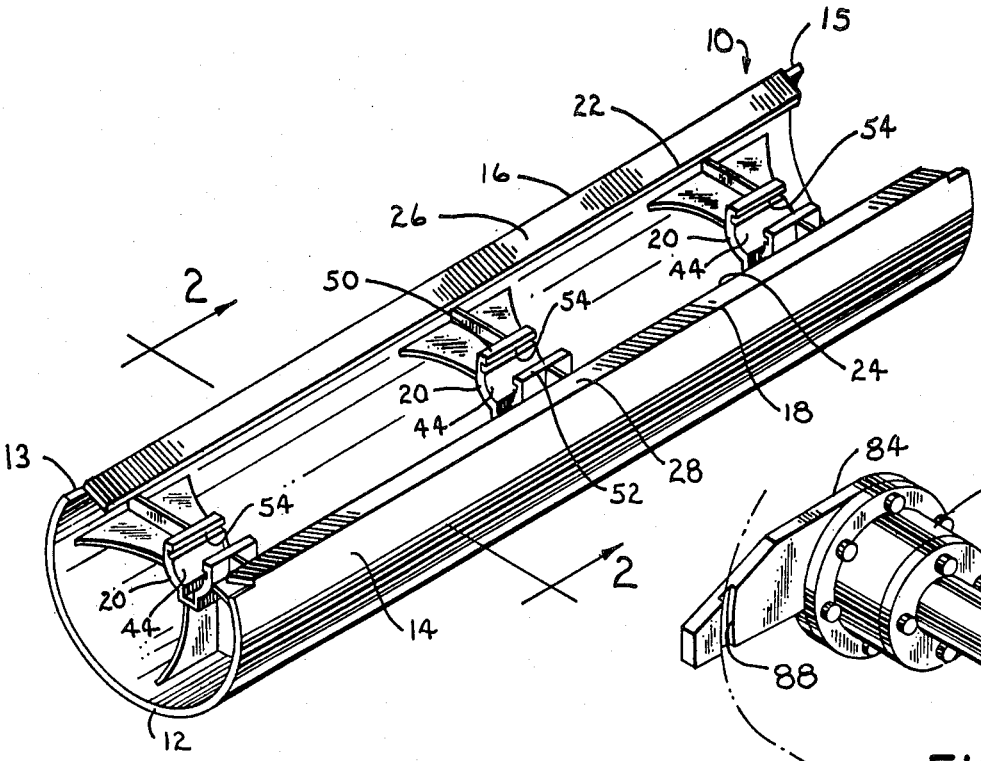
FIG. 1 is a perspective view of the improved skeleton wheel of the present invention before application of the coating and fabric covering.

Referring to FIG. 1 of the drawings there is illustrated an elongated member or skeleton wheel generally designated by the numeral 10 comprising the improved skeleton wheel or roller in accordance with the present invention. The skeleton wheel 10 is characterized by a partial cylindrical rim portion 12 which is adapted to be mounted on a press adjacent apparatus, not shown, such as delivery grippers or the like. Accordingly, the outer cylindrical surface 14 of the rim portion 12 has an opening extending the axial width of the skeleton wheel defined by leading and trailing edges 16 and 18, respectively. The skeleton wheel 12 includes a plurality of spaced apart hub portions 20 which may be integrally formed with the rim 12 to comprise a one piece integral casting of aluminum, for example. The hub portions 20 are connected to the rim portion 12 by webs 23, 25 and 27 and are adapted to provide for supporting the skeleton wheel rigidly secured for rotation on a shaft on a printing press in a manner similar to the mounting arrangement disclosed in U.S. Pat. No. 3,791,644 or by an improved arrangement to be discussed herein. As shown in FIG. 1, the skeleton wheel 10 includes opposed elongated integral flange portions 22 and 24 which extend generally inwardly from the surface 14 of the rim 12. The flange portions 22 and 24 include elongated flat surfaces 26 and 28 provided for a purpose to be described further herein.

Figure 2:
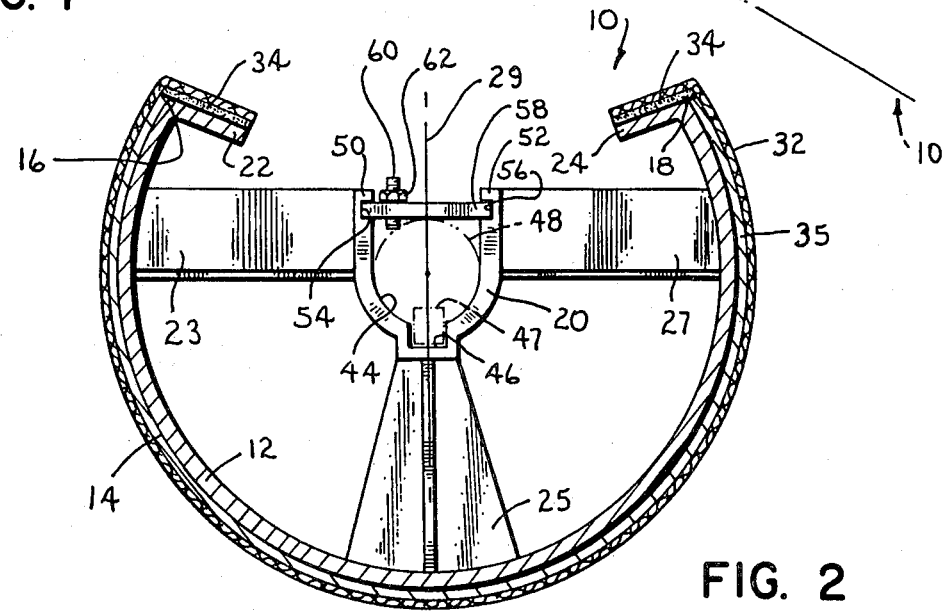
FIG. 2 is a detail section view taken along the line 2—2 of FIG. 1 showing the layers of materials covering the circumferential surface of the wheel.
Figure 3:
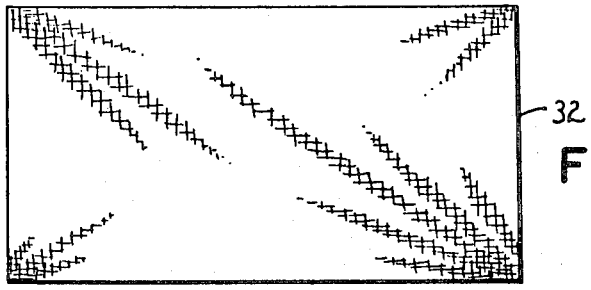
FIG. 3 is a plan view of a piece of fabric covering adapted for mounting on the skeleton wheel of the present invention.

Referring now to FIG. 2 of the drawings there is illustrated in detail the improved surface construction of the skeleton wheel of the present invention including the fabric covering providing supporting contact with the printed side of a piece of sheet material while conveying the sheet toward a printing station or toward the press delivery magazine. Although the fluoroplastic covered skeleton wheel disclosed in my previous patent provided improvements in handling freshly inked sheet material I have discovered that, unexpectedly, the provision of a layer of fabric on the supporting surface of the skeleton wheel and rather loosely secured thereto further enhances the ability of the skeleton wheel to support and convey successive sheets of printed material with wet ink thereon without transfering the wet ink from a previous sheet to a successive sheet and without marring or depressing the surface of the paper. In accordance with the present invention it has been determined that a woven fabric, preferably cotton, of a relatively loose weave on the order of what is commonly known as gauze has produced the unexpected improvement in a method and apparatus for handling printed material that has wet ink on the surface thereof as it passes over and is supported by the skeleton cylinder. A suitable fabric in accordance with the present invention and illustrated in the embodiment of FIG. 3 comprises a loosely woven, lightweight cotton material such as gauze. A cloth having a forty count or forty mesh, such as the piece of fabric 32 illustrated in FIGS. 2 and 3, treated in accordance with the present invention and attached to the surfaces of the flanges 22 and 24 in a suitable manner has produced the unexpected improvement in the handling of printed sheet material in printing presses and the like. The piece of fabric 32 is preferably of rectangular shape dimensioned to completely cover the outer cylindrical surface of the rim 12.

A preferred method of preparing the fabric piece 32 in accordance with the present invention involves washing the fabric in water in the presence of a suitable fabric softener dissolved therein in rather liberal quantities. One suitable fabric softener which has been used in preparation of the fabric piece 32 is manufactured under the trademark "DOWNY" and, in the washing process, two to three times the normal recommended quantity of softener has been used for washing the fabric in plain water. After washing the fabric piece 32 and allowing same to dry a suitable fabric protector is applied to enhance the liquid repellancy characteristics of the material. A preferred type of fabric protector is manufactured under the trademark SCOTCHGARD by the 3M Manufacturing Company, Minneapolis, Minn. as their Part No. FC4101-C-12. Moreover, it has been determined that even though some ink will accumulate on the surface of the fabric threads over an extended period of operating time the provision of the fabric protector permits the occasional rubbing or agitation of the fabric by the press operator in place on the skeleton cylinder to break loose and remove dried ink particles or crystals which have accumulated on the fabric without requiring removal and washing of the fabric piece.

Referring to FIG. 2 a suitable method of attaching the fabric piece 32 to the outer surface of the rim 12 is by a double sided adhesive tape strip 32 disposed on and extending the length of each of the respective surfaces 26 and 28. Another suitable method of attaching the fabric piece 32 would be by the use of fastener strips such as of the type made under the trademark VELCRO. Those skilled in the art will appreciate that other means may be provided for attaching the fabric piece 32 to the flanges 22 and 24, however, the abovementioned methods provide for quickly attaching and removing the fabric piece 32 with respect to the wheel 10.

An important aspect of the present invention concerns the type of fabric support surface provided on the rim 12 and overlying the surface 14. The improved surface is preferably of a low coeffecient of friction such as may be provided by coating the metal surface 14 of the cylinder with a fluoroplastic as taught by U.S. Pat. No. 3,791,644. Although the combination of the coating described in the abovementioned patent together with the fabric member 32 attached thereover provides suitable performance it has been discovered that the fabric covering for the skeleton wheel 10 performs somewhat better in eliminating any marring or depressions in the surface of the sheet material by the application of a coating including a fabric reinforcement as will be described herein.

Referring to FIG. 2 the rim portion 12 of the skeleton wheel 10 is provided with a coating 35 comprising a fluorocarbon composite coating material applied in one or more coats over a fabric base which is adhesively bonded to the cylindrical circumferential 14 of the rim portion 12. It is believed that the provision of the fabric base for the coating such as described herein provides a cushioning effect for the fabric piece 32 which is applied over the coating 35 and which reduces the tendency for the fabric piece 32 to indent or form depressions in the surface of the sheet material as well as substantially preventing the transfer of wet ink from one sheet to a successive sheet.

In a preferred method of preparing and forming the coating 35 a suitable piece of fabric such as cotton canvas of approximately 0.022 inch nominal thickness and having a waterproofing applied to one side thereof is cut somewhat oversize, approximately 4 to 5 inches all around, from the actual size required to cover the entire surface 14. The fabric is then suitably tacked to a substantially flat and smooth preparation surface to prevent movement or shrinkage while a first coat of the fluoropolymer or fluorocarbon material is applied thereto. A preferred composition for providing the coating 35 is a liquid fluoropolymer coating made under the trademark XYLAN by the Whitford Corporation, Westchester, Pa. A satisfactory coating material of the type referred to hereinabove is XYLAN 1010 composite type coating material which is self curing at room temperature.

After the aforedescribed fabric base is temporarily fastened to a suitable surface with the waterproof side facing said surface the non waterproofed side of the fabric is sanded lightly with a 220 grit paper to bring out the nap of the fabric. One coat of XYLAN 1010 coating material is then applied to the aforedescribed fabric and allowed to cure at room temperature. Once the first coating layer has been allowed to dry the coated fabric is removed from the temporary preparation surface and bonded to the surface 14 of the rim 12 using a suitable adhesive such as a contact cement made by 3M Corporation. The surface of the coated fabric piece which is applied to the surface of the rim portion 12 is the waterproofed side. The surface 14 is normally prepared for application of the adhesive in the prescribed manner to be clean and dry. Care should be taken to roll out the coated fabric piece of the coating 35 when it is applied to the surface 14 to prevent entrapment of air bubbles or the like.

After the adhesive is allowed to dry the fabric is trimmed to size and additional coatings of the fluoropolymer are applied and allowed to dry between coats. A suitable coating 35 is formed by the application of three additional layers of XYLAN 1010 coating material after the fabric base has been bonded to the surface of the rim 12. The surface formed by the coating 35 is preferably sanded lightly between each coat of fluoropolymer with, for example, 400 grit finishing paper.

The preparation of the surface coating 35 as aforedescribed provides a substantially glazed surface with a low coefficient of friction which is ink repellent and also provides for ease of movement of the fabric piece 32 when the same is attached to the cylinder 10. Although, in accordance with the present invention, the fluoropolymer coating described is particularly advantageous it is contemplated that other low friction plastic coatings may be applied to the aforementioned fabric base to produce a suitable surface for the fabric member 32. The particular fluorocarbon type coating of the general class of coatings referred to herein has produced the unexpected improvement of reducing ink transfer of one sheet to another in high speed printing equipment and has also, in combination with the fabric member 32, reduced depressing or indenting of the paper surface of the sheets. After the coating 35 has been prepared the fabric piece 32 is applied to the flanges 22 and 24 by the adhesive stripes 34 or other suitable fastening means loose enough so that with normal finger pressure the fabric may be locally moved over the surface of the coating 35 in all directions at least one eighth inch to one inch. Moreover, in printing presses in which the drive train has become loose with wear, for example, relative movement between the press impression cylinder and the skeleton wheel will not result in smearing of the ink thanks to the movability of the fabric covering with respect to the cylinder rim.

The improved skeleton wheel or cylinder of the present invention also includes improved means for attaching the wheel to the associated driving shaft of the printing press. Referring to FIGS. 1 and 2, the spaced apart hub portions 20 are provided with semi-cylindrical support surfaces 44 which are intersected by a suitable keyway 46 in which may be disposed a key 47 for drivingly engaging the skeleton wheel 12 with a press drive shaft indicated by the numeral 48 in FIG. 2. The hub portions 20 are provided with an improved retention means for mounting the skeleton wheel 10 on the shaft 48. The spaced apart hub portions 20 are each formed with integral axially extending bosses 50 and 52 spaced apart sufficiently to allow the skeleton wheel to be slipped radially on and off of the shaft 48. The bosses 50 and 52 are provided with opposed axially extending slots 54 and 56, respectively, which are aligned with each other to permit the insertion of a retaining plate 58. The retaining plate 58 is preferably of a length slightly less than the span between the bottoms of the grooves 54 and 56 so that the plate fits snugly in the respective grooves. The plate is preferably of a width equal to the axial length of the bosses 50 and 52. As shown in FIG. 2, the retaining plate 58 is provided with a socket head lock screw 60 threadedly engaged with the retaining plate and provided with a suitable lock nut 62. The lock screw 60 is offset from the center line which bisects the opening between the spaced apart bosses 50 and 52.

The lock screws 60 are adapted to be tightened to engage the periphery of the shaft 48 to prevent axial sliding of the skeleton wheel 10 with respect to the shaft and to permit minor radial adjustment of the skeleton wheel with respect to the shaft. When installing the cylinder 10 on the shaft 48 or removing the cylinder from the shaft the improved retaining plate 58 may be inserted in and removed from the respective grooves 54 and 56 followed by tightening or loosening of the screws 60, as the case may be, to provide a simplified arrangement for mounting and removing the cylinder with respect to the associated press drive shaft. The leading and trailing edges 16 and 18 are advantageously disposed substantially equidistant from the centerline 29 so that in some applications the skeleton wheel 10 can be turned end for end when the leading edge becomes worn or damaged.

Another feature of the present invention which has permitted improved retrofitting of a skeleton wheel such as the wheel 10 on certain types of press equipment is provided by the axially extending portions 13 and 15 of the rim 12 which extend in opposite directions respectively from the flanges 22 and 24. In certain types of presses such as a model TP-38A made by the Miller Printing Equipment Companpy one or more stationary side plates are located adjacent ends of the skeleton wheel or cylinder and are positioned such that certain lengths of printed material will overlap the side plates and will be disfigured while being conveyed past the plates under the support of the skeleton wheel because the wheel cannot be moved axially on the shaft to the non printed area of the sheet. However, with the improved skeleton cylinder 10 having the axially extending rim portions 13 and 15, a suitable annular groove may be cut in the side plates to accommodate the axial length of the wheel 10 to thereby substantially support the full length of the sheet material as it is conveyed by the wheel.

Figure 4:
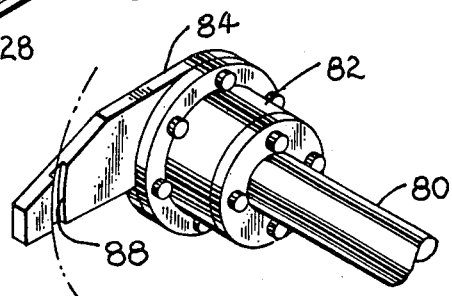
FIG. 4 is a detailed perspective view of a portion of a press adapted to use the skeleton wheel of the present invention.

Referring to FIG. 4 there is shown a detail view of a portion of a skeleton wheel support shaft 80 similar to the shaft 48. The shaft 80 is supported in a bearing assembly 82 which is bolted to a support assembly including a side plate member 84. The plate 84 is stationary and prevents the use of a skeleton wheel or cylinder having a length substantially equal to the length of the sheet and providing adequate support thereof. However, by forming the annular groove 88 to have radial and axial dimensions with respect to the longitudinal centerline of the shaft 80 sufficient to clear the axial end portions 13 or 15 of the rim 12, the cylinder 10 may be installed on a press equipped as shown to support substantially the entire length of the sheet material.

Those skilled in the art will appreciate that various modifications to the method and apparatus of the present invention may be made without departing from the scope of the invention as defined in the appended claims.

What I claim is:

1. A method for supporting and conveying sheet material which has been freshly printed and discharged from a printing press or the like without marring the freshly inked surface, comprising the steps of:

providing a skeleton wheel having a sheet supporting surface thereon;

providing a piece of fabric;

attaching said piece of fabric to said skeleton wheel to be disposed over at least that part of said surface which supports said sheet material, said piece of fabric being attached relatively loosely to permit and accomodate slight movement between the fabric and the skeleton wheel when the sheet material is supported and conveyed by skeleton wheel and rotating said skeleton wheel to engage successive sheets of said sheet material in supportive and conveying relationship thereto by said piece of fabric without marring said freshly printed surface.

2. The method as set forth in claim 1 together with the steps of:

providing said piece of fabric of woven cloth.

3. The method set forth in claim 2 wherein:

said cloth is provided of woven substantially qauzelike cotton material on the order of about forty mesh.

4. The method set forth in claim 1 or 3 together with the steps of:

treating said fabric with a liquid repellent prior to attaching said piece of fabric to said skeleton wheel.

5. The method set forth in claim 4 together with the steps of treating said fabric with a fabric softening material prior to treating said fabric with liquid repellent.

6. The method set forth in claim 1 together with the steps of:

providing an ink repellent coating on said surface for supporting said piece of fabric.

7. The method set forth in claim 6 wherein:

said coating includes a polytetrafluoroethylene.

8. The method set forth in claim 6 together with the step of:

providing a fabric base portion for said coating.

9. In a skeleton wheel for supporting and transferring a freshly printed sheet from a printing station on a printing press or the like without marring the freshly inked surface;

a generally cylindrical rim segment having a generally cylindrical support surface formed thereon; and a fabric covering disposed over at least a part of said support surface for supportively engaging one side of said sheet during the transfer thereof; and means for securing said fabric covering to extend relatively loosely over said support surface to permit and accomodate slight movement between the fabric covering and said support surface when the printed sheet is supported and transferred by the skeleton wheel so that the freshly printed sheet is not marred.

10. The invention set forth in claim 9 wherein:

said fabric covering comprises woven substantially gauzelike cotton material on the order of about forty mesh.

11. The invention set forth in claim 10 wherein:

said fabric covering is treated with a liquid repellent.

12. The invention set forth in claim 10 wherein said fabric covering is treated with a fabric softening agent.

13. The invention set forth in claim 9 wherein:

said generally cylindrical support surface is delimited in a circumferential direction by opposed elongated flanges, and said skeleton wheel includes means for removably attaching said fabric covering to said wheel along said flanges.

14. The invention set forth in claim 13 wherein:

said means for attaching includes an adhesive strip mounted on said flanges.

15. The invention set forth in claim 13 wherein:

said rim segment extends axially beyond said flanges for supporting substantially the entire length of said sheet.

16. The invention set forth in claim 9 or 13 wherein:

said surface includes a low friction coating thereon.

17. The invention set forth in claim 16 wherein:

said coating comprises at least one layer comprising polytetrafluoroethylene.

18. The invention set forth in claim 16 wherein:

said coating includes a fabric layer on which at least one layer of a fluoropolymer coating is applied.

19. The invention set forth in claim 18 wherein:

said fabric layer is a woven canvas.

20. A method of supporting and conveying sheet material which has been freshly inked and discharged from a printing press or the like without marring the freshly inked surface, comprising the steps of:

forming an ink repellent coating on a sheet supporting surface of a skeleton wheel;

treating a piece of fabric with a fabric softening agent;

treating the piece of fabric with a liquid repellent subsequent to treatment with said fabric softening agent;

attaching the piece of fabric to the skeleton wheel to cover the sheet supporting surface, said attaching step including mounting the piece of fabric relatively loosely over the sheet supporting surface such that the piece of fabric is capable of accommodating relative movement between the sheet material and the sheet supporting surface substantially without marring or damaging the freshly inked sheet material; and rotating the skeleton wheel to engage successive sheets of the sheet material in supportive and conveying relation with the piece of fabric.

21. The method of claim 20 wherein said step of forming an ink repellent coating comprises the steps of applying an ink repellent agent to a fabric base portion and securing the fabric base portion to the skeleton wheel.

22. The method of claim 20 wherein the skeleton wheel sheet supporting surface has a generally cylindrical shape interrupted by an opening extending the axial width of the skeleton wheel, said opening being bounded by a pair of generally radially inwardly directed flanges, and wherein said attaching step comprises wrapping the piece of fabric about the sheet supporting surface and securing opposite ends of the piece of fabric respectively to the flanges.

23. A skeleton wheel for supporting and transferring a freshly inked printed sheet from a printing station of a printing press or the like without marring the freshly inked surface, comprising:

a wheel member having a generally cylindrical sheet supporting surface with an ink repellent coating formed thereon;

a fabric covering comprising a woven cloth treated with a fabric softening agent and then treated with a liquid repellent agent; and means for attaching said fabric covering relatively loosely to said wheel member to cover said sheet supporting surface such that said fabric covering is capable of accommodating sufficient relative movement between a printed sheet supported and transferred thereby and said sheet supporting surface substantially without marring or damaging the printed sheet.

24. The skeleton wheel of claim 23 wherein said ink repellent coating comprises a fabric base portion with at least one layer of a fluoropolymer material applied thereon.

25. The skeleton wheel of claim 24 wherein said fabric base portion is formed from a canvas sheet.

* * * * *

UNITED STATES PATENT AND TRADEMARK OFFICE

CERTIFICATE OF CORRECTION

PATENT NO. : 4,402,267

DATED : September 6, 1983

INVENTOR(S) : Howard W. DeMoore

It is certified that error appears in the above-identified patent and that said Letters Patent is hereby corrected as shown below:

Column 5, line 9, after "circumferential" insert -- surface --.

Column 7, line 56, after "by" insert -- said --.

Signed and Sealed this

Sixth Day of December 1983

[SEAL]

*Attest:*

GERALD J. MOSSINGHOFF

*Attesting Officer*

*Commissioner of Patents and Trademarks*